US008590725B2

(12) United States Patent
Chartrel et al.

(10) Patent No.: US 8,590,725 B2
(45) Date of Patent: Nov. 26, 2013

(54) FLEXIBLE CONTAINER FOR PACKAGING SOLID PARTICULATE MATERIALS IN BULK, AND USE THEREOF

(75) Inventors: Bernard Chartrel, Lestrem (FR); Jean-Pierre Lecocq, Vaudricourt (FR); Nicolas Francois Chevalier, Le Breuil (FR)

(73) Assignees: Roquette Freres, Lestrem (FR); Greif Flexibles France SAS, Montceau les Mines (FR)

( * ) Notice: Subject to any disclaimer, the term of this patent is extended or adjusted under 35 U.S.C. 154(b) by 0 days.

(21) Appl. No.: 13/319,795

(22) PCT Filed: May 12, 2010

(86) PCT No.: PCT/FR2010/050933

§ 371 (c)(1),
(2), (4) Date: Nov. 10, 2011

(87) PCT Pub. No.: WO2010/130961

PCT Pub. Date: Nov. 18, 2010

(65) Prior Publication Data

US 2012/0055932 A1 Mar. 8, 2012

(30) Foreign Application Priority Data

May 14, 2009 (FR) ..... 09 53178

(51) Int. Cl.
*B65D 25/18* (2006.01)
*B65D 5/58* (2006.01)

(52) U.S. Cl.
USPC ..... 220/495.1; 229/117.27

(58) Field of Classification Search
USPC ..... 220/9.3, 9.2, 9.1, 495.08, 495.04, 220/495.03, 495.1, 23.89, 23.87, 23.86, 220/23.83; 383/4, 36, 41, 38, 119, 105; 229/117.34, 117.33, 117.32, 117.27; 206/595, 223, 216

IPC ..... B65D 25/18,25/14, 35/14, 90/04, 5/56, B65D 5/58

See application file for complete search history.

(56) References Cited

U.S. PATENT DOCUMENTS

| | | | | |
|---|---|---|---|---|
| 1,907,082 | A * | 5/1933 | Meltzer | 220/495.06 |
| 5,289,937 | A * | 3/1994 | Boots | 220/9.1 |
| 6,900,975 | B2 | 5/2005 | Levi | |

FOREIGN PATENT DOCUMENTS

| | | |
|---|---|---|
| DE | 20 2005 004174 | 6/2005 |
| FR | 1 530 621 | 10/1968 |
| WO | 92/14660 | 9/1992 |
| WO | 92/21572 | 12/1992 |

OTHER PUBLICATIONS

International Search Report dated Sep. 2, 2010, corresponding to PCT/FR2010/050933.

* cited by examiner

*Primary Examiner* — Jacob K Ackun
*Assistant Examiner* — Robert J Hicks
(74) *Attorney, Agent, or Firm* — Young & Thompson

(57) ABSTRACT

A flexible container for packaging solid particulate materials in bulk, includes a bottom (1), four substantially rectangular outer side walls (2) and a cap, characterized in that, inside the flexible container, a tube made of a flexible material and having a height lower than the height of the outer side walls is attached by vertical attachment lines (5) on the four outer side walls (2) of the vessel in order to define a central compartment (6) and four peripheral compartments separated from the central compartment by four inner walls (8*a*, 8*b*, 8*c*, 8*d*), respectively, each of the inner walls including a central pouring element (11) at the upper edge thereof.

15 Claims, 2 Drawing Sheets

Figure 1:
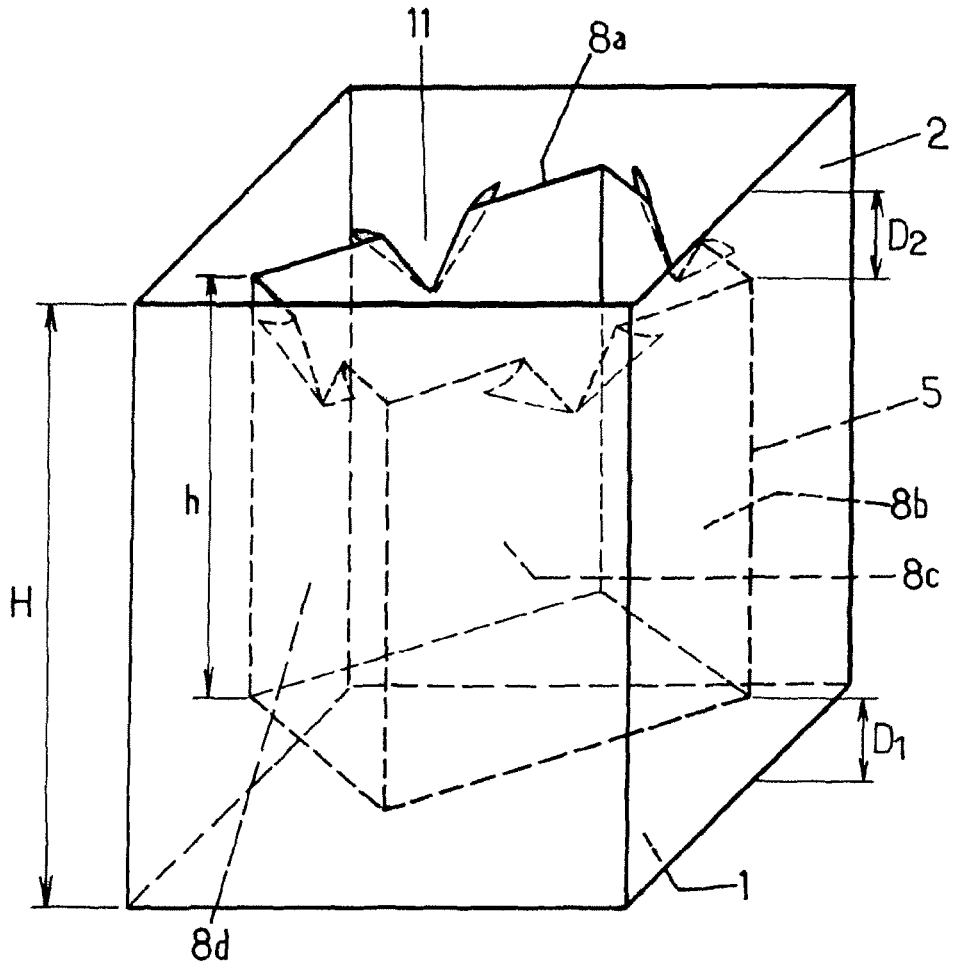

FLEXIBLE CONTAINER FOR PACKAGING SOLID PARTICULATE MATERIALS IN BULK, AND USE THEREOF

The present invention relates to a novel flexible container for packaging solid particulate materials in bulk, and a method for filling such a container.

Large flexible containers, intended for the packaging of large quantities of solid particulate materials, also called FIBC (flexible intermediate bulk container) bags, or even "big bags", have been known for many years and used for the protection, storage and transportation of solid particulate materials in bulk such as foodstuffs (sugar, flour, starch), polymer granules or chemical products.

These containers are conventionally made of polymer fiber fabric (for example PP, HDPE, LLDPE), possibly made watertight by coating.

The capacity of these containers is generally between 0.5 and 2 $m^3$. The large size and weight of the containers, once filled, make them difficult to handle, even dangerous in certain cases. In practice, when, to optimize the use of storage spaces, it is decided to stack the filled bags to several levels, it is essential to ensure the perfect stability of the stacks, because an imbalance can rapidly lead to slips and falls with damaging consequences.

Moreover, despite their rectangular bottom which should normally allow the available transportation and storage surface area to be almost totally filled, the great pressure that the bulk materials exert on the flexible lateral walls of the containers means that their actual form substantially deviates from their ideal parallelepipedal form. Thus, in a truck with a ground surface area of 32 $m^2$, it is impossible to juxtapose more than 24 filled containers, each with a square base of 1 m×1 m.

The applicants have also found that, despite the great weight of the filled containers, a small number of bags could become overturned during transportation in trucks, making them very difficult, or even impossible, to unload using fork-lift trucks.

It is also routine practice to subject the container, after it has been filled, to vibrations intended to obtain an optimum packing of the bulk materials. The filling appliances used to deliver such vibrations are heavy, complex and very expensive. In such an appliance, the container is raised relative to the ground, because of the presence of the vibrator at the base of the appliance. Consequently, any human intervention during the filling method, for example when placing or withdrawing the filling device or in the event of an operating accident, takes place at a certain distance from the ground which obviously presents fall risks.

In their research aiming to optimize the packaging of solid particulate materials in bulk in flexible containers of "big bag" type, the Applicants have discovered a relatively simple means for overcoming all the drawbacks itemized above. In fact, the Applicants have found that the creation, inside the volume of the flexible container, of a set of compartments communicating with one another, made it possible, surprisingly, to obtain filled bags whose form approximates more closely to that of a rectangular parallelepiped than that of the known containers. The less rounded form of the filled containers of the present invention made it possible to store and transport a larger number thereof in a given space. In a truck with a surface area of 32 $m^2$, it was thus possible to juxtapose 26 containers instead of 24. The bags according to the invention also offered the advantage of being much more stable than the known bags without any internal walls, and were never toppled over during transportation in trucks.

Another advantage of the containers of the present invention lies in the possibility of filling them satisfactorily, in the absence of any vibration system. This makes it possible, throughout the filling method, to place them equally on the ground or simply on pallets, so that any human intervention at the cap level of the container does not then present any risk of falling. It goes without saying that the installation for filling the bags of the present invention can be designed, in the absence of a vibrator, much more simply.

The very great stability of the containers of the present invention also makes it possible to stack them to three levels, which represents a considerable space saving compared to the known bags which, for the abovementioned safety reasons, could be stacked only to two levels.

Finally, it is routine practice to leave the containers to rest, after filling, for a certain time, of the order of a few hours, in order to allow the air to escape before handling the filled bag. By virtue of the containers and the method of the invention, this rest time, previously necessary for the packing of the particulate material, is superfluous and it becomes possible to apply just-in-time working methods.

Flexible containers are already known for the packaging of solid particulate materials in bulk with inserts. Thus, the patent U.S. Pat. No. 6,900,975 discloses FIBC-type bags that include inserts consisting of strips of antistatic fibers. These strips do not, however, form true inner walls as described hereinbelow, capable of imposing an order of filling of the different internal compartments of the bags. When a particulate material is poured from above into a container as described in U.S. Pat. No. 6,900,975, it uniformly fills the entire extent of the base of the bag and is not first retained in the central compartment and then poured, by overflow, into the other compartments as in the present invention.

The flexible containers described in these documents do not therefore make it possible to obtain bags, filled with solid particulate materials in bulk, that have a stability equivalent to that of the bags of the present invention.

It is important to note that the advantages described above can be obtained by virtue of a simple and inexpensive novel design of the containers. The containers of the present invention are distinguished in fact from the known containers by the fact that a simple tube made of flexible material is fixed by vertical fixing lines to each of the four lateral walls of the container, thus defining a central compartment and four angular, or peripheral compartments.

Consequently, the subject of the present invention is a flexible container for packaging solid particulate materials in bulk, comprising a bottom, four essentially rectangular outer lateral walls and a cap, characterized in that, inside the flexible container, a tube made of a flexible material, having a height less than the height of the outer lateral walls, is fixed by vertical fixing lines to the four outer lateral walls of the container so as to define a central compartment, open at the top and the bottom, and four peripheral compartments separated from the central compartment respectively by four inner walls, each of the inner walls having, on its top edge, a central pouring means.

The tube made of flexible material, also called skirt, can be characterized by its length and by its perimeter. It will easily be understood that, after fixing the tube to the outer lateral walls of the container, the length of the tube corresponds to the height h of each of the inner walls and the perimeter of the tube to the sum of the widths of the four inner walls.

As indicated above, the height h of each of the inner walls is less than the height H of the outer lateral walls of the container. Preferably, the ratio of the height h of the four inner walls to the height H of the outer lateral walls is between 0.65 and 0.9, preferably between 0.7 and 0.85.

The inner walls formed by fixing the tube to the outer lateral walls are preferably not in contact with the bottom of the container, but their bottom edge, preferably substantially horizontal, is situated at a certain distance D1 from the bottom of the flexible container. This allows communication between the central compartment and each of the four peripheral compartments. When filling the container, the particulate material, introduced into the central compartment from above, can thus be spread over the entire base of the container up to a certain height which is limited by the distance D1. This initial filling of the entire base of the container is essential for the satisfactory progress of the method because it guarantees the stability of the bag during the filling of the central compartment. Said distance D1 is preferably between 4 and 12%, in particular between 5 and 10% of the total height H of the outer lateral walls of the container. In other words, for a container with a height of 150 cm, the bottom edge of the inner walls is preferably situated at a distance of between 6 and 18 cm.

Similarly, the top edge, substantially horizontal, of the four inner walls is not at the level of the top edge of the container, but is situated at a certain vertical distance D2 therefrom. This distance D2 is preferably between 5 and 20%, in particular between 10 and 15% of the total height H of the outer lateral walls of the container. In other words, for a container with a height of 150 cm, the top edge of the inner walls is situated at a vertical distance D2 of between 7.5 and 30 cm.

Each of the inner walls has, at the center of its top edge, a pouring means which makes it possible to channel, or centralize, the overflow, or flow, of the particulate material when the central compartment is almost full. This pouring means may in principle have any form, provided that it allows the flow of particulate material, overflowing from the central compartment, to be directed to each of the peripheral compartments. Examples of pouring means include a central slot or a central notch. The position, the size and the depth of the pouring means are advantageously chosen so that the flow of the particulate material from the central compartment to the peripheral compartments, during the filling of the peripheral compartments, is done only via these pouring means. In other words, it seems important to avoid having the flow of particulate material entering into the container overflow in an uncontrolled manner over the entire extent of the top edges of the lateral walls.

The dimensions of the pouring means thus depend obviously on the speed of filling of the containers and those skilled in the art will be able to adjust them accordingly. As a general rule, when the pouring means is a notch or a simple slot formed in the center of the top edge of each of the inner walls, the depth P thereof is preferably between 5 and 15% of the height h of each of the inner walls.

By virtue of their particular internal structure, the filling of the flexible containers of the present invention is essentially broken down into four phases:

- a first phase of filling the base of the bag essentially over the entire extent thereof,
- a second phase of filling the central compartment during which the filling of the peripheral compartments, defined by the lateral walls, is non-existent or negligible,
- a third phase of filling the peripheral compartments by pouring particulate material from the central compartment via the pouring means; this phase begins towards the end of the central compartment filling phase as soon as the level of the particulate material arrives at the level of the pouring means,
- a fourth phase, optional, of filling the top part of the bag, beyond the top edge of the inner walls.

It will easily be understood that, for the filling of the flexible container to proceed in this way, the lateral walls must be designed so as to retain the particulate material in the central compartment during the second phase. In other words, the inner walls are preferably solid walls, without any orifices or slots other than the central slot on the top edge. It would of course be possible to envisage the presence of orifices of small or very small size, linked for example to the textile structure of the material forming the lateral walls, but the run-off of the particulate material through these small orifices must be negligible relative to the filling which is done during the third phase via the pouring means.

The tube made of flexible material is fixed to the four outer lateral walls of the container by substantially vertical fixing lines. These fixing lines are advantageously stitch lines or weld lines, preferably stitch lines. The tube may be fixed by one or, for reasons of solidity, by several parallel fixing lines to each of the outer lateral walls. When the fixing is done by several parallel lines, all are situated preferably in the central vertical region of the lateral wall, in particular in the vertical region of said wall covering less than 20%, preferably less than 15% of the width of the lateral wall.

The perimeter of the tube made of flexible material fixed to the lateral walls obviously depends on the total perimeter of the cross section of the container. It should both be less than the latter and have sufficient value for the tube not to exert an excessive pulling force on the lateral walls when the bag is filled. It can be calculated that the ratio of the perimeter of the cross section of the flexible bag (=4×width of the outer lateral walls) to the perimeter of the cross section of the tube (=perimeter of the central compartment) is preferably between 1.27 and 1.41, these two values corresponding respectively to a circular central compartment and to a square central compartment.

The cap of the flexible container of the present invention may in principle have any form that is known or even unknown in the art, provided that it does not affect the intrinsic qualities of the present invention. The invention relates in fact primarily to the vertical parts (outer lateral walls and inner walls) and not to the horizontal parts (bottom and cap) of the container.

In a particular embodiment, the cap of the container has the form of a hopper with a central filling orifice and, similarly, the bottom of the flexible container has the form of a hopper with a central draining orifice. The filling and draining orifices may be closed by any appropriate closure means. Filling and draining chutes are preferably provided respectively in the cap and the bottom of the bags. These chutes are preferably fitted externally with tie links fixed by stitching when assembling the fabric elements. The closure is done by knotting the links, generally on a fold of the swan-neck-shaped chutes.

Also the subject of the present invention is a method for packaging solid particulate materials in bulk using the flexible container as described above. This method comprises the pouring of the solid particulate materials in bulk to be packaged from the top of the flexible container into the central compartment thereof, the solid particulate material first filling the base of the bag, then the central compartment then, by overflow, the four peripheral compartments of the container. The four distinct phases of the method according to the invention have been described hereinabove.

As explained in the introduction, the flexible containers of the present invention, once filled, exhibit an excellent stability, even when they have not been subjected to vibrations during their filling. Consequently, in a preferred embodiment of the method of the invention, the flexible container is not subject, during its filling, to vibrations intended to increase the degree of packing of the solid particulate materials in bulk.

The Applicants have found that it was advantageous not to totally fill the flexible containers according to the invention. It is recommended to stop the pouring of the solid particulate material through the filling orifice when the volume fill rate of the flexible container is between 90 and 99%, preferably between 92 and 95%, of complete filling. This stopping before complete filling of the bag makes it possible to prevent the blocking of the filling duct of the station which would falsify the weight of the product.

Figure 2:
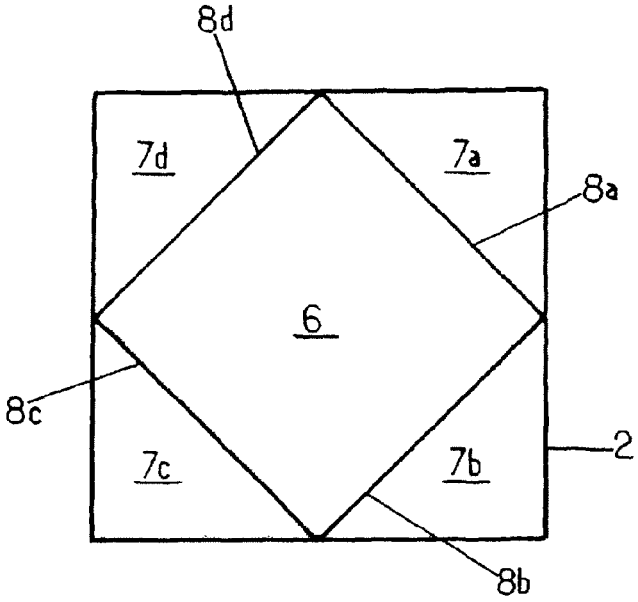
Figure 3:
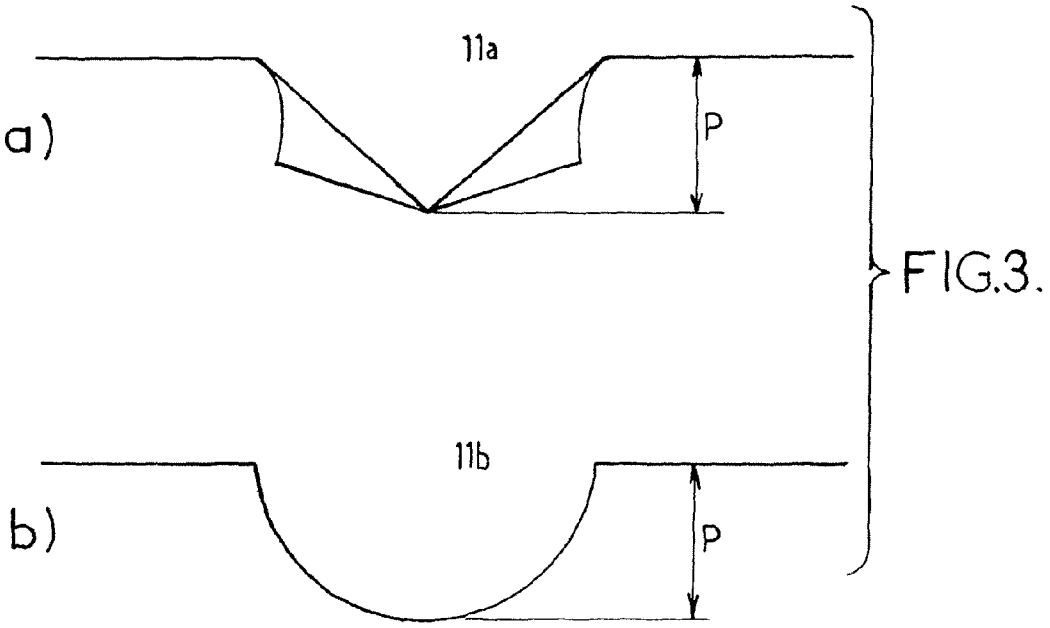

The present invention is now explained in detail with reference to the appended figures, in which, FIG. 1 is a perspective view of a container according to the invention, FIG. 2 shows a cross section of a container according to the invention at approximately mid-height, and FIG. 3 is a detail view of the top edge of an inner wall showing two different embodiments of the pouring means.

FIG. 1 illustrates a flexible container according to the invention comprising a bottom 1 and four outer lateral walls 2 of height H. In this figure, the cap has been omitted for simplification purposes. Inside the volume defined by the bottom 1 and the four lateral walls 2, a tube made of flexible material is fixed by four vertical fixing lines 5 respectively to the four outer lateral walls 2. Each of the vertical fixing lines 5 is substantially at the center of each of the outer lateral walls 2. Between two vertical fixing lines 5 on two adjacent outer lateral walls there are thus defined four inner walls 8*a*, 8*b*, 8*c*, 8*d* of height h (less than the height H of the outer lateral walls 2). The four inner walls define, on the one hand, a central compartment that is open at the top and bottom and, on the other hand, four peripheral compartments which are also open at the top and the bottom. The central compartment is thus in fluidic communication with the peripheral compartments. The bottom end of each vertical fixing line 5 is at a distance D1 from the bottom 1 of the container and the top end of each vertical fixing line 5 is at a distance D2 from the top edge of the container. Each of the inner walls 8*a*-8*d* includes, on its top edge, a notch 11*b*.

FIG. 2 represents the cross section of the container of FIG. 1 at approximately mid-height thereof. The four inner walls 8*a*, 8*b*, 8*c*, 8*d*, fixed to the outer lateral walls 2 by fixing lines 5, define a square-shaped central compartment 6 and four identical peripheral compartments 7*a*, 7*b*, 7*c*, 7*d* of triangular section.

FIG. 3 shows two embodiments of the pouring means, namely (a) a slot 11*a* of depth P at the center of the top edge of the inner wall, and (b) a rounded notch 11*b* of depth P at the center of the top edge of the inner wall.

The invention claimed is:

1. A flexible container for packaging solid particulate materials in bulk, comprising a bottom (1), four essentially rectangular outer lateral walls (2) and a cap (3), wherein inside the flexible container, a tube made of a flexible material, having a height less than the height of the outer lateral walls, is fixed by vertical fixing lines (5) to the four outer lateral walls (2) of the container so as to define a central compartment (4) and four peripheral compartments (7*a*, 7*b*, 7*c*, 7*d*) separated from the central compartment respectively by four inner walls (8*a*, 8*b*, 8*c*, 8*d*), each of the inner walls having a top edge and on each top edge, a central pouring means.

2. The flexible container as claimed in claim 1, having a ratio of height (h) of the four inner walls (8*a*, 8*b*, 8*c*, 8*d*) to height (H) of the outer lateral walls (2) between 0.65 and 0.9.

3. The flexible container as claimed in claim 1, wherein the four inner walls each have a substantially horizontal bottom edge (9) which is situated at a certain distance (D1) from the bottom of the flexible container, thus establishing a communication between the central compartment (6) and each of the four peripheral compartments (7*a*, 7*b*, 7*c*, 7*d*), said distance (D1) being between 4 and 12% of the total height (H) of the outer lateral walls of the container.

4. The flexible container as claimed in claim 1, wherein the four inner walls each have a substantially horizontal top edge (10) which is situated at a certain distance (D2) from the top edge of the flexible container, said distance (D2) being between 5 and 20% of the total height (H) of the outer lateral walls of the container.

5. The flexible container as claimed in claim 1 wherein the pouring means is a central slot (11*a*) or a central notch (11*b*).

6. The flexible container as claimed in claim 1 wherein the depth (P) of the central slot (11*a*) or of the central notch (11*b*) is between 5 and 15% of the height (h) of each of the inner walls.

7. The flexible container as claimed in claim 1 wherein the inner walls (8*a*, 8*b*, 8*c*, 8*d*) are solid walls without any orifices.

8. The flexible container as claimed in claim 1 having a ratio of perimeter of the cross section of the flexible bag (=4×width of the outer lateral walls) to perimeter of the cross section of the tube (4) (=perimeter of the central compartment) is between 1.27 and 1.41.

9. The flexible container as claimed in claim 1 wherein the vertical fixing lines (5) are stitch or weld lines.

10. The flexible container as claimed in claim 1 wherein the cap (3) of the flexible container has the form of a hopper with a central filling orifice.

11. The flexible container as claimed in claim 1 wherein the bottom (1) of the flexible container has the form of a hopper with a central draining orifice.

12. The flexible container as claimed in claim 2 wherein the ratio is between 0.7 and 0.85.

13. The flexible container as claimed in claim 3 wherein the distance (D1) is between 5 and 10% of the total height (H) of the outer lateral walls of the container.

14. The flexible container as claimed in claim 4 wherein the distance (D2) is between 10 and 15% of the total height (H) of the outer lateral walls of the container.

15. The flexible container as claimed in claim 9, wherein the vertical fixing lines (5) are stitch lines.

* * * * *